US005108629A

United States Patent [19]

Matsuda et al.

[11] Patent Number: 5,108,629

[45] Date of Patent: Apr. 28, 1992

[54] ORGANIC LUBRICATING COATING COMPOSITION FOR USE IN PLASTIC DEFORMATION OF METAL SHEET

[75] Inventors: Hisamichi Matsuda, Amagasaki; Show Onodera, Nishinomiya; Takaharu Ishizaki, Amagasaki; Shigeru Wakano, Kobe; Tadashi Sakane, Amagasaki, all of Japan

[73] Assignees: Nippon Oil & Fats Co., Ltd., Tokyo; Sumitomo Metal Industries, Ltd., Osaka, both of Japan

[21] Appl. No.: 635,696

[22] Filed: Dec. 28, 1990

[30] Foreign Application Priority Data

Dec. 29, 1989 [JP] Japan ..... 1-342169

[51] Int. Cl.[5] ..... C10M 107/28; C10M 173/02; C10M 145/16

[52] U.S. Cl. ..... 252/11; 252/49.3; 252/56 D; 106/38.2

[58] Field of Search ..... 252/56 D, 11, 49.3; 106/38.2

[56] References Cited

U.S. PATENT DOCUMENTS 2,978,395 4/1961 Hollyday, Jr. et al. ..... 252/56 D
3,629,112 12/1971 Gower et al. ..... 252/56 D
3,645,897 2/1972 Gower et al. ..... 252/49.5
4,052,323 10/1977 Feneberger et al. ..... 252/23
4,403,490 9/1983 Sargent ..... 252/49.5
4,416,132 11/1983 Sargent ..... 252/49.5
4,548,725 10/1985 Bridger ..... 252/56 D
4,839,074 6/1989 Rossi et al. ..... 252/56 D

FOREIGN PATENT DOCUMENTS 2104095 3/1983 United Kingdom .

*Primary Examiner*—Group: Karl
*Assistant Examiner*—Deborah Jones
*Attorney, Agent, or Firm*—Burns, Doane, Swecker & Mathis

[57] ABSTRACT

An organic lubricating coating composition for use in plastic deformation of a metal sheet comprises a maleic anhydride/styrene copolymer which has been at least partially esterified with one or more organic hydroxy compounds, or a salt of the esterified copolymer. The molar ratio of the maleic anhydride component to the styrene component in the copolymer is in the range of from 1:99 to 75:25. At least 10% by weight of the organic hydroxy compounds is comprised of a long-chain hydroxy compound containing from 10 to 30 carbon atoms.

19 Claims, 2 Drawing Sheets

Fig. 1
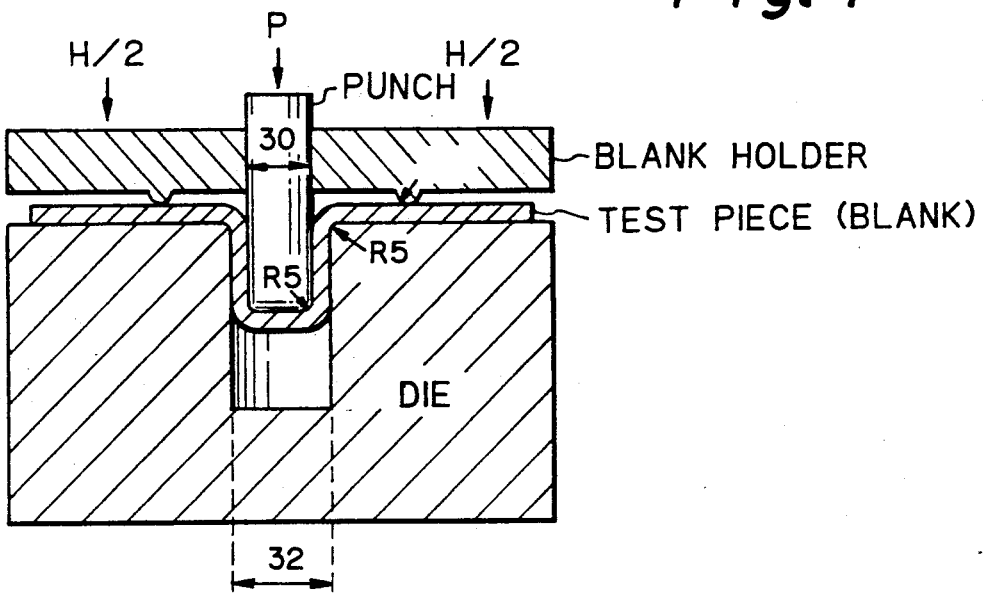
Fig. 2a
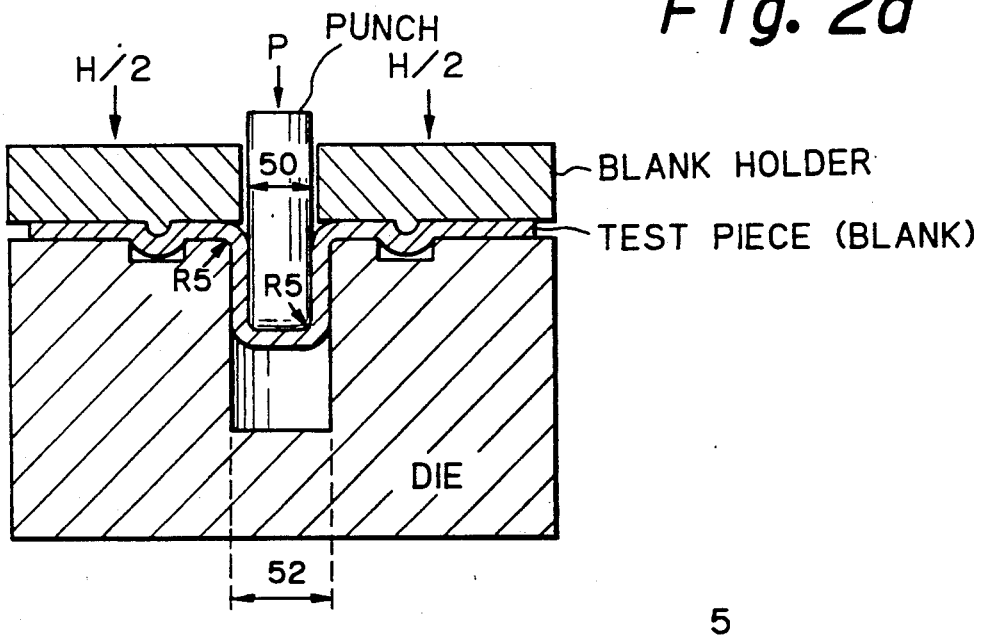
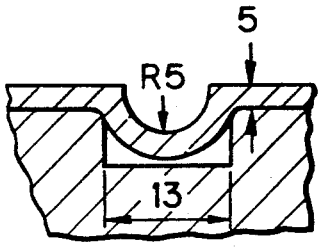
Fig. 2b

ORGANIC LUBRICATING COATING COMPOSITION FOR USE IN PLASTIC DEFORMATION OF METAL SHEET

BACKGROUND OF THE INVENTION

The present invention relates to an organic lubricating coating composition suitable for use in plastic deformation of a metal sheet. More particularly, the present invention relates to an organic lubricating coating composition capable of significantly improving the formability of a metal sheet during plastic deformation and having improved removability from the metal sheet by washing with an aqueous washing solution after plastic deformation. The present invention also relates to a lubricated metal sheet coated with such a coating composition.

In the forming of a metal sheet such as a steel sheet by plastic deformation using a die, a lubricant is conventionally applied to the metal sheet in order to increase slippage between the metal sheet and the die, thereby reducing the required forming load and preventing galling of the metal sheet. Recently, however, in view of environmental and other problems involved in the application of a high viscosity lubricant to a metal sheet, lubricated metal sheets having a solid lubricating coating already formed at the sheet-making stage or a subsequent appropriate stage have been widely used.

The lubricating coating on lubricated metal sheets is usually formed form an organic lubricating coating composition comprising one or more lubricants and one or more organic film-forming resins.

Organic film-forming resins which have been used to form a lubricating coating include acrylic resins, epoxy resins, melamine resins, phenolic resins, and the like. As the lubricants, fatty acids, fatty acid alkali metal salts, metallic soaps, fatty acid esters, fatty acid amides, fatty alcohols, polyethylene powder, graphite, molybdenum disulfide, fluoroplastic powder, etc. have been used.

For example, Japanese Patent Application Kokai No. 62-84193(1987) discloses an aqueous dispersion of an acrylic resin and a metallic soap as a lubricating coating composition. A combination of wax with a water-soluble resin is described in Japanese Patent Publication No. 52-22948(1977). A combination of a polymethacrylate resin and a mineral oil is disclosed in Japanese Patent Application Kokai No. 54-40259(1979), while a combination of a thermosetting acrylic resin, surfactant and wax is described in Japanese Patent Application Kokai No. 63-8489(1988).

An organic lubricating coating composition for plastic deformation of a metal sheet, particularly for use in the preparation of lubricated metal sheets must be able to form a coating having the following properties:

(b 1) good lubricating properties even with a thin coating;

(2) non-tackiness or anti-blocking when a coated lubricated metal sheet contacts another coated lubricated metal sheet; and (3) easy removal by washing with an aqueous washing solution since it must be removed after plastic deformation.

Most of the conventional organic lubricating coating composition for use in plastic deformation do not meet all the above-mentioned requirements sufficiently.

Lubricating coating compositions based on wax, which are known to have good lubricating properties, must be applied after they are diluted with an organic solvent. However, the use of an organic solvent makes handling troublesome and is undesirable from an environmental viewpoint. Furthermore, these coating compositions suffers another problem that removal of a coating formed therefrom is difficult.

In order to eliminate these problems, it has bee proposed to use an aqueous dispersion or emulsion of wax. Such a dispersion or emulsion can be applied to a metal sheet in the absence of an organic solvent, but due to the strong hydrophobic nature of the wax, it is difficult to remove the resulting lubricating coating by washing with an aqueous washing solution. Therefore, after forming the metal sheet, the lubricating coating must be removed by washing under severe conditions such as by washing with an organic solvent or a boiling alkaline solution.

Lubricating coating compositions based on a water-soluble resin or a water-dispersible resin such as an acrylate resin have the advantage that a coating thereof can be easily removed due to the hydrophilic nature of the resin. However, such a resin does not have a long-chain alkyl or alkenyl group in the molecule which contributes to lubricity of the resin. Therefore, the thickness of the coating must be increased in order to achieve an adequate degree of lubricity. In some cases it is necessary for the lubricating coating to have a thickness as large as several tens of micrometers, which is highly disadvantageous from an economical viewpoint.

SUMMARY OF THE INVENTION

An object of the present invention is to provide a novel organic lubricating coating composition for use in plastic deformation of a metal sheet, the coating composition meeting all the above-mentioned requirements (1) to (3).

Another object of the present invention is to provide a lubricated metal sheet such as a steel sheet having a lubricating coating of such a coating composition.

These and other objects and advantages of the present invention will be apparent from the following description.

In one aspect, the present invention is an organic lubricating coating composition for use in plastic deformation of a metal sheet comprising a maleic anhydride/styrene copolymer which has been at least partially esterified with one or more organic hydroxy compounds, or a salt of the esterified maleic anhydride/styrene copolymer, wherein the molar ratio of the maleic anhydride component to the styrene component in the copolymer is in the range of from 1:99 to 75:25, and wherein at least 10% by weight of the organic hydroxy compounds is comprised of a hydroxy compound having an alkyl or alkenyl group containing from 10 to 30 carbon atoms.

In another aspect, the present invention is a lubricated metal sheet having a coating formed from such an organic lubricating coating composition.

BRIEF DESCRIPTION OF THE DRAWINGS

FIG. 1 is a schematic cross-sectional view of a flat die and a punch with a beaded blank holder used in a hat channel (U-shaped) drawing test to determine a frictional coefficient;

FIG. 2*a* and 2*b* are schematic cross-sectional views of a recessed die and a punch with a beaded blank holder used in another U-shaped drawing test to evaluate lubricity.

Figure 3A:
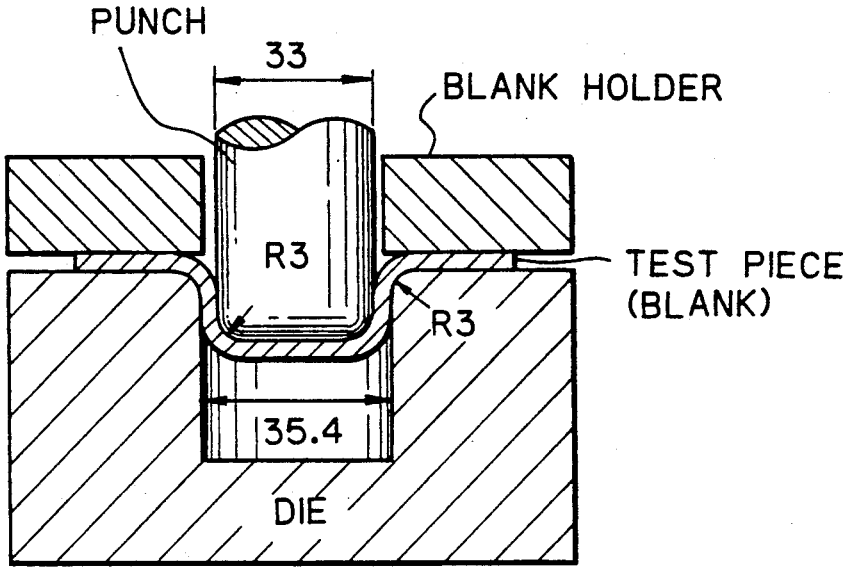
FIG. 3*a* and 3*b* are schematic cross-sectional views of a die and a punch used in a flat-bottom cup drawing test to evaluate deep drawability, all of these tests being employed in examples of the present invention.

In the Figures, R5 and R3 indicate the radius curvatures of the die and punch and the numerical values indicate the diameters in millimeter.

DESCRIPTION OF THE PREFERRED EMBODIMENTS

The lubricating coating composition of the present invention is useful for the forming by plastic deformation of various metal sheets including not only steel sheets such as cold-rolled steel sheets, plated steel sheets, e.g., having a zinc or zinc alloy plating layer as galvanized steel sheets and galvannealed (alloyed galvanized) steel sheets, and stainless steel sheets, but also sheets of a wide variety of metals such as aluminum, nickel, zirconium, titanium, and the like.

The metal sheets encompass hot-rolled metal sheets which may be pickled after hot rolling, cold-rolled metal sheets, surface-treated metal sheets, e.g., those having a plated, melt sprayed, or vapor-deposited coating, multilayer metal sheets such as clad metal sheets, and any other metal sheets to which plastic deformation is applicable.

The maleic anhydride/styrene copolymer used herein is a copolymer derived from maleic anhydride or its functional derivative and a styrene monomer as major monomers.

Preferably the maleic anhydride/styrene copolymer is a copolymer of maleic anhydride and styrene. However, all or part of the maleic anhydride may be replaced by its functional derivative such as maleic acid, a maleate ester, a maleic acid salt, a maleinamide, or a maleimide. Similarly, all or part of the styrene may be replaced by a substituted styrene such as α-methyl styrene.

The copolymer comprises recurring units derived from the maleic anhydride monomer (maleic anhydride component) in a concentration of 1–75 mole %, preferably 10–50 mole %, and those from the styrene monomer (styrene component) in a concentration of 99–25 mole %, preferably 90–50 mole %, based on the total concentration of these recurring units. In other words, the molar ratio of the maleic anhydride component to the styrene component in the copolymer is in the range of from 1:99 to 75:25 and preferably from 10:90 to 50:50.

When the concentration of the maleic anhydride component is less than 1 mole %, a satisfactory degree of lubricity cannot be obtained due to a decrease in the amount of a long-chain alkyl or alkenyl group incorporated in the copolymer by the subsequent esterification. When it is more than 75 mole %, the resulting lubricating coating is weak so that good plastic deformability cannot be obtained.

In addition to the maleic anhydride and styrene components, the copolymer may contain recurring units derived from one or more other monomers. Examples of other monomers which may be incorporated in the copolymer include other ethylenically unsaturated monomers such as olefins and their derivatives, ethylenically unsaturated carboxylic acids and their derivatives, and vinyl alcohol and its derivatives. These other monomers should be incorporated in the copolymer in a total molar amount less than the total molar amount of the maleic anhydride and styrene monomers.

The maleic anhydride/styrene copolymer preferably has a number-average molecular weight in the range of 200–100,000 and more preferably in the range of 500–10,000. With a copolymer having a number-average molecular weight of less than 200, a lubricating coating having a sufficient strength cannot be obtained. When the molecular weight exceeds 100,000, the viscosity of the resulting coating composition is so high as to cause inconvenience during application.

The copolymer can be formed by any commercially feasible polymerization method including vapor phase polymerization, bulk polymerization, solution polymerization, and emulsion polymerization.

Vapor phase polymerization can be performed by introducing the monomers in vapor phase into an autoclave heated to 100°–300° C. to cause polymerization in the presence or absence of a polymerization catalyst. Bulk or solution polymerization can be carried out by introducing the monomers in molten form or in solution dissolved in a chemically inert solvent into an autoclave heated to 60°–200° C. to cause polymerization in the presence of a polymerization catalyst. The former method is suitable for the preparation of a maleic anhydride/styrene copolymer having a relatively low molecular weight in the range of 200–10,000, while the latter is suitable for the preparation of a copolymer having a relatively high molecular weight in the range of 5,000–100,000.

The lubricating coating composition of the present invention comprises one or more maleic anhydride/styrene copolymers which have been at least partially esterified with one or more organic hydroxy compounds. At least 10% by weight of the hydroxy compounds is comprised of a long-chain hydroxy compound having an alkyl or alkenyl group containing from 10 to 30 carbon atoms.

The long chain hydroxy compound has at least one alcoholic hydroxyl group and at least one long chain alkyl or alkenyl group containing from 10 to 30 carbon atoms. Examples of such a compound are aliphatic alcohols having a saturated or unsaturated, straight or branched long-chain alkyl or alkenyl group, e.g., alcohols prepared by hydrogenation of a natural fatty acid or synthetic alcohols derived from an olefin or polyolefin; epoxide adducts of these aliphatic alcohols prepared by an addition reaction of an epoxide compound such as ethylene oxide, propylene oxide, butylene oxide, glycidol, or styrene oxide with the above-mentioned aliphatic alcohols; and monoesters of a fatty acid (such as a natural fatty acid or a synthetic fatty acid derived from an olefin or a polyolefin) having a saturated or unsaturated, straight or branched chain alkyl or alkenyl group with a polyalkylene glycol. The polyalkylene glycol is a polymer of an alkylene oxide such as ethylene oxide, propylene oxide, and butylene oxide.

Preferred long-chain hydroxy compounds are monohydroxy compounds having an alkyl or alkenyl group containing from 12 to 22 carbon atoms and an alcoholic hydroxyl group. Examples of these compounds are aliphatic monohydric alcohols such as lauryl alcohol, tridecyl alcohol, myristyl alcohol, pentadecyl alcohol, palmityl alcohol, heptadecyl alcohol, stearyl alcohol, arachidyl alcohol, behenyl alcohol, oleyl alcohol, and elaidyl alcohol; aliphatic alcohol-epoxide adducts prepared by addition of an epoxide compound exemplified above to the aliphatic monohydric alcohols; and monoesters with a polyalkylene glycol of a saturated or unsaturated natural fatty acid such as lauric acid, myristic acid, palmitic acid, stearic acid, arachidic acid, behenic acid, oleic acid, elaidic acid, or erucic acid, or a synthetic fatty acid derived from an olefin or a polyolefin.

Also included in the long-chain hydroxy compound are polyhydroxy compounds having two or more hydroxyl groups partially esterified with the above-mentioned fatty acid or partially etherified with the above-mentioned monohydric alcohol, and epoxide adducts of the partially esterified or etherified polyhydroxy compounds. Examples of the polyhydroxy compounds are polyols such as ethylene glycol, propylene glycol, butylene glycol, hexamethylene glycol, glycerine, polyglycerine, trimethylolpropane, pentaerythritol, dipentaerythritol, sorbitan, sorbitol, sucrose, and polyvinyl alcohol, as well as partial esters and condensates of these polyols and epoxide adducts of these polyols, partial esters, and condensates.

Other useful long-chain hydroxy compounds include epoxide adducts of phenolic compounds having a $C_{10}$–$C_{30}$ alkyl or alkenyl group; aromatic or alicyclic alcohols having a $C_{10}$–$C_{30}$ alkyl or alkenyl group and epoxide adducts of these alcohols; epoxide adducts of amines and polyamines having a $C_{10}$–$C_{30}$ alkyl or alkenyl group; alkanolamides of the above-exemplified fatty acids and their epoxide adducts; and epoxide adducts of nitrogen-containing compounds including ammonia, amines, polyamines, and amides which have been partially esterified with the above-described fatty acid or partially etherified with the above-mentioned aliphatic alcohol.

One or more of the above-mentioned long-chain hydroxy compounds can be used in the esterification of the maleic anhydride/styrene copolymer.

One or more other hydroxy compounds may be additionally used in combination with the above-mentioned long-chain hydroxy compounds. Other hydroxy compounds include monohydroxy or polyhydroxy compounds having no alkyl or alkenyl group or those having one or more alkyl or alkenyl groups each containing less than 10 carbon atoms (hereinafter referred to as short chain alkyl or alkenyl groups).

Examples of these hydroxy compounds useful as other hydroxy compounds are aliphatic alcohols having one or more saturated or unsaturated, straight or branched short-chain alkyl or alkenyl groups and epoxide adducts thereof; aromatic alcohols such as benzyl alcohol and epoxide adducts thereof; alicyclic alcohols such as cyclohexanol and epoxide adducts thereof; polyhydroxy compounds having two or more alcoholic hydroxyl groups, including polyols such as ethylene glycol, propylene glycol, butylene glycol, hexamethylene glycol, glycerine, polyglycerine, trimethylolpropane, pentaerythritol, dipentaerythritol, sorbitan, sorbitol, sucrose, and polyvinyl alcohol, partial esters and condensates of these polyols, and epoxide adducts of these polyols, partial esters, and condensates; partial esters and ethers of these polyhydroxy compounds and epoxide adducts of the partial esters and ethers; epoxide adducts of phenols such as phenol (hydroxybenzene); epoxide adducts of nitrogen-containing compounds including ammonia, amines, polyamines, amides, and amine salts, and partial esters and ethers thereof; and polycondensates and cross-linked products of the foregoing short-chain hydroxy compounds.

At least 10% and preferably at least 30% by weight of the hydroxy compounds used in the esterification of the maleic anhydride/styrene copolymer is comprised of a long-chain hydroxy compound having an alkyl or alkenyl group containing from 10 to 30 carbon atoms. When the proportion of the long-chain compound in the entire hydroxy compounds used in the esterification of the copolymer is less than 10% by weight, the resulting coating composition cannot provide a satisfactory degree of lubricity.

The maleic anhydride/styrene copolymer is at least partially esterified with one or more hydroxy compounds. By the esterification, at least part of the carboxyl groups and carboxyl derivative groups such as acid anhydride, ester, salt, amide, and imide groups present in the copolymer are reacted with the hydroxy compounds to form ester linkages.

The degree of esterification of the copolymer is at least 5 mole % based on the total number of carboxyl and carboxyl derivative groups present in the molecule of the copolymer. The degree of esterification is preferably in the range of 10–90 mole % and more preferably in the range of 20–70 mole %.

When the degree of esterification is less than 5 mole %, the proportion of a long-chain alkyl or alkenyl group introduced into the copolymer molecule is too low to attain a satisfactory degree of lubricity.

On the other hand, when the degree of esterification is more than 90 mole %, the hydrophilicity of the resulting ester becomes poor. In this case, it is desirable to take an appropriate measure to increase the hydrophilic properties of the esterified copolymer to such a degree that there are no difficulties in the preparation of an aqueous coating composition based on the ester or in the removal of a lubricating coating after plastic deformation. The hydrophilic properties of the esterified copolymer can be increased, by using a short-chain hydroxy compound as a part of the hydroxy compounds to be reacted with the copolymer, by using an hydroxy compound having a highly hydrophilic oxyethylene chain or amine salt moiety in the molecule, or by reacting a polyhydric hydroxy compound such as a polyol-ethylene oxide adduct in a stoichiometrically excess amount so as to introduce hydroxyl groups into the esterified copolymer, for example. When such a measure is taken, even a complete ester in which the copolymer is 100% esterified can be used in the preparation of the coating composition.

The esterification method is not critical and any commercially feasible esterification method can be employed. The esterification can be performed in a conventional manner, such as by heating a mixture of the copolymer and the hydroxy compound in the presence or absence of an appropriate solvent in a nitrogen atmosphere at 80°–250° C. If necessary, an esterification catalyst such as sulfuric acid or p-toluenesulfonic acid may be added to the reaction mixture. Alternatively, the esterification may be carried out by adding dropwise the hydroxy compound to the copolymer which has been heated to the reaction temperature. When an esterified product having a degree of esterification of less than 50% is desired, the esterification can be achieved at a lower temperature through a ring-opening reaction of the acid anhydride ring moiety in the copolymer. When the copolymer has an ester moiety, as in the cases where a maleate ester such as methyl maleate is used as a monomer in the preparation of the copolymer, the esterification can be readily accomplished by means of a transesterification reaction.

The organic lubricating coating composition of the present invention comprises the above-mentioned at least partially esterified copolymer or its salt as an essential component. The esterified copolymer or its salt is present in the coating composition in the form of a solution, emulsion, or dispersion in a suitable liquid medium. The liquid medium preferably comprises water. In other words, an aqueous coating composition is preferred.

A salt of the esterified copolymer can be prepared by reacting the esterified copolymer with a basic compound when the copolymer has been esterified partially. In this case, unreacted carboxyl groups remaining in the copolymer are neutralized with the basic compound. When the copolymer is completed esterified, the ester may be hydrolyzed to introduce free carboxyl groups into the molecule and then reacted with a basic compound to form a salt of the esterified copolymer. In either case, carboxyl groups derived from the maleic anhydride monomer or its derivative are neutralized with the basic compound.

By converting the esterified copolymer into its salt, the hydrophilic properties of the copolymer can be improved so that the preparation of an aqueous coating composition and removal of a lubricating coating after plastic deformation are further facilitated.

When an organic amine is used to form a salt, another advantage is obtained in that an amine salt of the esterified copolymer can improve the adhesion of a lubricating coating to a metal sheet, thereby improving the overall properties of the coating.

The basic compound used to form a salt of the esterified copolymer may be either an organic or inorganic base. Examples of the basic compound are nitrogen-containing compounds such as amines and ammonia and metal-containing bases such as alkali metal and alkaline earth metal compounds.

The nitrogen-containing bases include ammonia; aliphatic amines such as methylamine, ethylamine, butylamine, octylamine, dodecylamine, dimethylamine, and trimethylamine; alkanolamines such as monoethanolamine, diethanolamine, triethanolamine, and dihydroxypropylamine; aromatic amines such as aniline; cyclic amines such as morpholine; polyamines such as ethylenediamine, diethylenetriamine, hexamethylenediamine, and polyethyleneimine; and epoxide adducts of these compounds.

The metal-containing bases are preferably inorganic compounds and include metals capable of forming a carboxylate salt such as potassium, sodium, lithium, calcium, magnesium, aluminum, zinc, iron, nickel, cobalt, tin, lead, and copper, as well as oxides, hydroxides, chlorides, carbonates, and bicarbonates of these metals.

The neutralization of the esterified copolymer to form a salt can be performed in a conventional manner. For example, the esterified copolymer and the basic compound may be added to water and heated to 50°-80° C. when the copolymer has free carboxyl groups or to 60°-90° C. when it has carboxylic acid derivative groups. Such a neutralization procedure makes it possible to obtain a lubricating coating composition according to the present invention in which the resulting salt is dissolved, emulsified, or dispersed in water.

The lubricating coating composition is preferably an aqueous composition using water as the sole liquid medium to obtain ease of handling and avoid environmental problems caused by the use of an organic solvent.

However, if these problems can be overcome, the liquid medium may be one or more organic solvents or a mixture thereof with water. Useful organic solvents include hydrocarbons such as toluene, xylene, and kerosine; ketones such as acetone, methyl ethyl ketone, and methyl isobutyl ketone; ethers such as methyl butyl ether and diethylene glycol monomethyl ether; esters such as ethyl acetate; and alcohols such as methyl alcohol, ethyl alcohol, and propyl alcohol.

The presence of an organic solvent in the lubricating coating composition decreases the viscosity of the composition and makes it possible to increase the concentration of the esterified copolymer in the composition. Therefore, it facilitates the preparation and transportation of the composition. Furthermore, the use of an organic solvent offers additional advantages of a shorter operating time and a lower drying temperature when a lubricating coating is formed.

The esterified copolymer or its salt may be applied in molten form without use of a liquid medium, although this method of application causes various operational difficulties.

The concentration of the esterified copolymer or its salt in the lubricating coating composition is not critical as long as it has a viscosity enabling coating to be performed. Usually, the concentration is in the range of 1-50% and preferably 2-40% by weight in the case of an aqueous composition. A higher concentration may be employed in a composition with an organic solvent.

The lubricating coating composition may further comprise various additives which are conventionally employed in a lubricating coating composition. Such additives include waxes, fatty acids, alkali metal salts of fatty acids, metallic soaps, fatty alcohols, and fatty acid esters, amines, amine salts, amides, sulfonates, sulfonamides, and compounds having two or more of these functional moieties. When one or more of these additives are added, an aqueous coating composition in the form of a solution, emulsion, or dispersion can be easily prepared since the esterified copolymer or its salt serves as a solubilizer, emulsifier, or dispersant.

The lubricating coating composition can be readily applied to a metal sheet in a commercially feasible, conventional manner to provide a lubricated metal sheet having a lubricating coating thereon. For example, the composition can be applied to the metal sheet by dip coating, roll coating, curtain coating, spraying, electrostatic coating, or electrodeposition coating and the resulting wet coating can be dried by hot-air drying or irradiation with active energy rays to give a solid lubricating coating.

The coating weight is preferably in the range of 0.1-10 $g/m^2$ and more preferably in the range of 0.2-3 $g/m^2$ on a dry basis. A lower coating weight may not provide a satisfactory degree of lubricity, while a higher coating weight does not provide a further appreciable increase in lubricity and is disadvantageous from the viewpoint of costs.

The lubricating coating formed from the organic lubricating coating composition according to the present invention has a strong adhesion to sheets and a high degree of lubricity. The high lubricity is at least partly attributable to the long-chain alkyl or alkenyl groups introduced into the molecule of the maleic anhydride/styrene copolymer by esterification, while the strong adhesion results from the fact that the carboxyl groups or their salts are strongly chemically adsorbed by the surface of the metal sheet.

In spite of the high lubricity or oiliness, the lubricating coating still retains hydrophilic nature due to the presence of free or salted carboxyl groups and can be removed by washing with an aqueous washing solution such as an alkaline degreasing solution after it has been subjected to plastic deformation. Particularly, when the hydroxy compound used to esterify the copolymer has a long polyethylene oxide chain or a similar chain, the removability of the coating is further improved.

Furthermore, the lubricating coating has anti-blocking properties, as shown by the following examples. Therefore, when the lubricated metal sheet is stored under such conditions that the lubricating coating contacts another coating or a metal sheet, substantially no blocking occurs. As a result, it can be stored for a prolonged period without fear of blocking.

The following examples are presented as specific illustrations of the claimed invention. It should be noted that the invention is not limited to the specific details set forth in the examples.

EXAMPLES

A maleic anhydride/styrene copolymer (1/1 molar ratio) having a number-average molecular weight of about 1200 (SMA-1000A, KAWAHARA PETROCHEMICAL CO., LTD.) was partially esterified in the following manner to prepare a coating composition indicated as Run No. 1 in Table 1.

A mixture of 202 g of the copolymer, 148.8 g of lauryl alcohol (NAA-42, NIPPON OIL AND FATS CO., LTD.), and 1.8 g of p-toluenesulfonic acid as an esterification catalyst in 234.6 g of toluene was heated to 118° C. under nitrogen. The toluene solvent and the catalyst comprised 40% and 0.3%, respectively, of the total weight of the mixture. Water and toluene distilling from the reactor were collected and water was removed while toluene was returned to the reactor. After heating for 4 hours at 118° C., the temperature was raised to 140° C. to remove toluene by distillation.

The resulting viscous esterified copolymer solidified when it was allowed to cool to room temperature. To 350.8 g of the esterified copolymer, 150.0 g of a 28% aqueous ammonia and 3427.2 g of water were added and the mixture was stirred at 80° C. After about 1 hour, neutralization of the ester was completed and an emulsion was formed.

The emulsion had a pH of 9.41 and it was used as a lubricating coating composition in Run No. 1.

The coating compositions indicated as Runs Nos. 2 to 20 in Table 1 were prepared in a similar manner.

Table 1 shows the molar ratio of maleic anhydride to styrene in the copolymer, its number-average molecular weight, the long-chain hydroxy compound having a $C_{10}$–$C_{30}$ alkyl or alkenyl group used in the esterification and the degree of esterification therewith in mole percent, the non-long chain hydroxy compound having no $C_{10}$–$C_{30}$ alkyl or alkenyl group used in the esterification, if any, and the degree of esterification therewith in mole percent, the basic compound used to form a salt and the degree of neutralization therewith in mole percent, and the solvent or dispersion medium used to prepare a coating composition and the concentration of the esterified copolymer or its salt in the composition (solids content).

Each of the lubricating coating compositions shown in Table 1 was applied by using a bar coater to a 0.8 mm-thick galvannealed steel sheet (Example 1) and a 0.8 mm-thick cold-rolled steel sheet (Example 2) with a coating weight sufficient to form a dry film having a thickness of 1 μm and then dried in hot air to prepare a coated galvannealed steel sheet and a coated cold-rolled steel sheet, each having a lubricating coating on one surface.

The coated steel sheets were evaluated for lubricity, alkali washability, anti-blocking properties, and resistance to wash oil by the following testing methods.

Example 1

Coated Galvannealed Steel Sheet

Test 1: Measurement of Frictional Coefficient

A blank of the coated galvannealed steel sheet measuring 30 mm wide and 230 mm long was subjected to press forming using a flat die and a punch with a beaded blank holder for a hat channel (U-shaped) drawing test as shown in FIG. 1 while different pressures H (kgf/cm$^2$) were applied to the blank holder. The load P (kgf/cm$^2$) exerted on the punch to perform the forming was measured. The load P was plotted against the pressure H and the frictional coefficient was calculated from the slope of the resulting line according to the following equation:

$$\textit{Frictional Coefficient} = (dP/dH)/2.$$

Prior to each press forming test, the surfaces of the die and punch were abraded with emery abrasive paper to such a degree that they had a value for $R_{max}$ of 0.3 μm.

Test 2: Evaluation of Lubricity

Using a recessed die and a punch with a beaded blank holder for a U-shaped drawing test as shown in FIG. 2, a blank of the coated galvannealed steel sheet measuring 180 mm wide and 230 mm long was subjected to press forming under a pressure H (kgf/cm$^2$) of about 1000 (kgf/cm$^2$) applied to the blank holder. The change in the load P (kgf/cm$^2$) exerted on the punch was measured as an indication of lubricity when the test piece beneath the beaded portions of the blank holder underwent U-shaped forming. The smaller the change in the load required for forming, the better the lubricity of the test piece. Prior to each test, the surfaces of the die and punch were abraded in the same manner as in Test 1.

Test 3: Evaluation of Coating Removability by Washing with an Alkali Solution A metal sheet that has been subjected to forming by plastic deformation is usually washed with an aqueous alkaline solution prior to the subsequent paint coating stage in order to remove any non-protecting surface films and fats and oils remaining or deposited on the metal surface. Therefore, it is desirable that the lubricating coating formed from the coating composition of the present invention be readily removed by such washing after forming by plastic deformation has been completed.

In order to test the ease of removal of the lubricating coating by washing with an aqueous alkaline solution, a test piece of the coated galvannealed steel sheet was immersed in an aqueous 2% solution of an alkaline degreasing agent for use in an automobile paint coating line (Surfcleaner SD-550, NIPPON PAINT CO., LTD.) at 40° C. for 1 minute. After the test piece was rinsed with water for 1 minute, the wettability with water of the coated surface was evaluated as follows:

○: Completely wettable (100% of the area wetted),

Δ: Slight repellent (More than 80% of the area wetted),

×: Extremely repellent (Less than 80% of the area wetted).

Test 4: Evaluation of Anti-Blocking Properties

If coated steel sheets stored while stacked on one another exhibit blocking (tackiness between the coatings on adjacent coated steel sheets), the handling properties and lubricity of the coated steel sheets become significantly worse. For this reason, the anti-blocking properties of the coated galvannealed steel sheet were tested by stacking two test pieces of the coated steel sheet with the coated surfaces facing each other and pressing the stacked sheets under a pressure of 200 $kg/cm^2$ for 3 hours. The anti-blocking properties were evaluated by the ease of separation of the two sheets as follows:

◎: separated by gravity without traces of sticking,
○: separated by gravity with traces of sticking,
Δ: stuck together but separated upon light striking,
×: stuck together and not separated upon striking.

Test 5: Evaluation of Resistance to Wash Oil

Prior to press forming by plastic deformation, a steel sheet is frequently treated with wash oil to clean the surface and remove metal powder or other foreign matter deposited thereon which may cause the formation of defects and stains during plastic deformation. If the lubricating coating of the coated steel sheet is dissolved in the wash oil, the formability of the steel sheet will be deteriorated. Therefore, it is important that the coated steel sheet have good resistance to wash oil. For this reason, the coated steel sheet was tested with respect to resistance to wash oil.

The test was performed by immersing a test piece of the coated galvannealed steel sheet in a large amount of wash oil (Solvent Naphtha, IDEMITSU KOSAN CO., LTD.) for 24 hours at room temperature. It was then removed from the wash oil and after the remaining wash oil was removed by heating at 60° C. for 1 hour, the weight of the lubricating coating remaining on the steel sheet was measured. The resistance to wash oil was evaluated in terms of % retention of the lubricating coating on a weight basis.

The results of Tests 1 to 5 performed on the coated galvannealed steel sheets of Example 1 are shown in Table 2.

Example 2

Coated Cold-Rolled Steel Sheet

Test 6: Evaluation of Deep Drawability

Figure 3B:
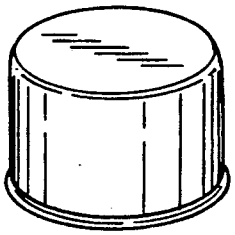

Using a die and a punch for a flat-bottom cup drawing test as shown in FIG. 3, a blank of the coated cold-rolled steel sheet was subjected to deep drawing. The initial blank diameter was varied to determine the maximum initial blank diameter D (mm) at which a press failure occurred. The deep drawability was evaluated by the LDR value which was calculated by dividing the maximum initial blank diameter D by the punch diameter d (mm).

$$LDR\ value = D/d$$

Prior to each test, the surfaces of the die and punch were abraded in the same manner as in Test 1.

Test 7: Evaluation of Coating Removability by Washing with an Alkali Solution

Using a test piece of the coated cold-rolled steel sheet, the removability of the lubricating coating was evaluated in the same manner as in Test 3.

Test 8: Evaluation of Anti-Blocking Properties

Using a test piece of the coated cold-rolled steel sheet, the anti-blocking properties of the lubricating coating were evaluated in the same manner as in Test 4.

Test 9: Evaluation of Resistance to Wash Oil

Using a test piece of the coated cold-rolled steel sheet, the resistance to wash oil of the lubricating coating was evaluated in the same manner as in Test 5.

The results of Tests 6 to 9 performed on the coated cold-rolled steel sheets of Example 2 are shown in Table 3.

As is apparent from the results shown in Tables 2 and 3, lubricated steel sheets having a lubricating coating formed from a coating composition of the present invention had better surface lubricity and plastic deformability than steel sheets coated with a comparable lubricating coating composition. Furthermore, the lubricating coatings could be readily removed by washing with an alkaline solution, were less susceptible to blocking during storage, and had a low solubility in wash oil.

TABLE 1

(Organic Lubricating Coating Compositions Employed in Examples)

| No. | (1) Copolymer Monomer reactants (molar ratio) | | M.W. | (2) Long-chain hydroxy compound used in esterification of (1) (contg. $C_{10}$–$C_{30}$ alkyl or alkenyl group)[2] | | % esterification of (1) with (2) |
|---|---|---|---|---|---|---|
| | | | THIS INVENTION | | | |
| 1 | MA[1]/styrene | (1/1) | 1200 | Lauryl alcohol | | 40 |
| 2 | MA/styrene | (1/1) | 1200 | Stearyl alcohol/1 mol EO | | 12 |
| 3 | MA/styrene | (1/2) | 2500 | Stearyl alcohol | 75% | 40 |
| | | | | Stearyl alc./7 mol EO | 25% | |
| 4 | MA/styrene | (1/2) | 2500 | Stearyl alcohol | 80% | 50 |
| | | | | Stearyl alc./15 mol EO | 20% | |
| 5 | MA/styrene | (1/2) | 2500 | Ethylene glycol monostearate | 40% | 50 |
| | | | | Palmityl alc./15 mol EO | 60% | |
| 6 | MA/styrene | (1/3) | 1600 | Oleyl alcohol | 20% | 85 |
| | | | | Lauryl alc./15 mol EO | 80% | |
| 7 | MA/styrene | (1/1) | 1200 | Stearyl alcohol | | 40 |
| 8 | MA/styrene | (1/1) | 1200 | Behenyl alcohol | | 10 |
| 9 | MA/styrene | (1/1) | 1200 | Stearyl alcohol/6 mol EO | | 40 |
| 10 | MA/styrene | (1/1) | 1200 | Propylene glycol monobehenate | | 30 |
| 11 | MA/styrene/acrylic acid | (1/9/1) | 4000 | Palmityl alcohol | 70% | 45 |
| | | | | FINE OXOCOL 2600[4] | 30% | |

TABLE 1-continued (Organic Lubricating Coating Compositions Employed in Examples)

| | | | | | |
|---|---|---|---|---|---|
| 12 | MA/styrene | (1/1) | 500 | Behenyl alcohol/20 mol EO | 50 |
| 13 | MA/styrene | (1/2) | 4000 | Sorbitan distearate/10 mol EO | 25 |
| 14 | MA/styrene | (1/2) | 4000 | Stearyl alcohol/2 mol PO | 10 |
| 15 | MA/styrene | (1/1) | 8000 | Stearyl alcohol | 36 |
| 16 | MA/styrene | (1/1) | 11200 | Diethylene glycol monostearate | 50 |
| 17 | MA/styrene | (1/3) | 2200 | Palmityl alcohol/20 mol EO | 40 |
| | | | COMPARATIVE | | |
| 18 | MA/styrene | (1/1) | 1200 | — | — |
| 19 | MA/styrene | (1/1) | 1200 | — | — |
| 20 | MA/styrene | (1/150) | 1300 | Stearyl alcohol/6 mol EO | 40 |
| 21 | | | | | |
| 22 | | | | | |

| No. | (3) Non-long chain hydroxy compound used in esterification of (1)[2] | % esterification of (1) with (3) | Basic compound used to form a salt (neutralization) | % Neutralization | Medium | Solids content (wt %) |
|---|---|---|---|---|---|---|
| | | | THIS INVENTION | | | |
| 1 | — | — | Ammonia | 100 | Water | 10 |
| 2 | — | — | Diethanolamine | 80 | Water | 10 |
| 3 | — | — | Monoethanolamine | 100 | Water | 10 |
| 4 | — | — | Monoethanolamine | 100 | Water | 10 |
| 5 | — | — | Triethanolamine | 60 | Water | 10 |
| 6 | — | — | NaOH | 90 | Water | 10 |
| 7 | PEG[3] (MW 400) | 5 | Ammonia | 100 | Water | 10 |
| 8 | PEG (MW 800) | 5 | Morpholine | 30 | Water | 10 |
| 9 | Methyl alcohol | 10 | KOH | 70 | Water | 10 |
| 10 | Nonylphenol/10 mol EO | 10 | Monomethylamine | 100 | Water | 10 |
| 11 | — | — | Diethanolamine | 100 | Water | 10 |
| 12 | — | — | Diethanolamine | 100 | Water | 10 |
| 13 | — | — | Dimethylamine | 100 | Water | 10 |
| 14 | Nonylphenol/8 mol EO | 40 | Hexamethylene diamine | 100 | Water | 10 |
| 15 | TEA[5]/4 mol EO | 4 | Monoethanolamine | 90 | Water | 10 |
| 16 | — | — | Triethanolamine | 80 | Water | 3 |
| 17 | Glycerine | 2 | Diethylamine | 100 | Water | 10 |
| | | | COMPARATIVE | | | |
| 18 | Octyl alcohol | 40 | Ammonia | 100 | Water | 10 |
| 19 | PEG (MW 800) | 5 | Morpholine | 30 | Water | 10 |
| 20 | Methyl alcohol | 10 | KOH | 70 | Water | 10 |
| 21 | Commercially available rust-preventive oil | | | | | 100 |
| 22 | Commercially available press oil (#600) | | | | | 100 |

Notes.
All the percents are molar percents unless otherwise indicated.
[1]MA = Maleic anhydride
[2]EO = Ethylene oxide. PO = Propylene oxide. The mark "/" means an adduct. For example, "Stearyl alcohol/6 mol EO" indicates an adduct of 6 moles of ethylene oxide to 1 mole of stearyl alcohol.
[3]PEG = Polyethylene glycol
[4]FINE OXOCOL: a trade name for a branched-chain synthetic alcohol (isohexacosanyl alcohol), hydroxyl value = 144, sold by NISSAN CHEMICAL INDUSTRIES, LTD.
[5]TEA = Triethanolamine

TABLE 3

(Test Results of Coated Cold-Rolled Steel Sheets)

| Composition No. | Test 6 LDR value | Test 7 Removability with Alkali | Test 8 Anti-block Properties | Test 9 Resistance to wash oil |
|---|---|---|---|---|
| | | THIS INVENTION | | |
| 1 | 2.3 | Δ | ○ | 80 |
| 2 | 2.3 | Δ | ○ | 87 |
| 3 | 2.6 | ○ | ◎ | 90 |
| 4 | 2.6 | ○ | ○ | 94 |
| 5 | 2.5 | ○ | ○ | 93 |
| 6 | 2.3 | Δ | Δ | 59 |
| 7 | 2.6 | ○ | ○ | 86 |
| 8 | 2.3 | ○ | ○ | 88 |
| 9 | 2.5 | ○ | ◎ | 72 |
| 10 | 2.3 | ○ | ○ | 90 |
| 11 | 2.3 | Δ | ○ | 64 |
| 12 | 2.6 | Δ | Δ | 72 |
| 13 | 2.4 | Δ | Δ | 91 |

TABLE 3-continued (Test Results of Coated Cold-Rolled Steel Sheets)

| Composition No. | Test 6 LDR value | Test 7 Removability with Alkali | Test 8 Anti-block Properties | Test 9 Resistance to wash oil |
|---|---|---|---|---|
| 14 | 2.4 | ○ | ◎ | 91 |
| 15 | 2.6 | ○ | ○ | 85 |
| 16 | 2.6 | ○ | ◎ | 86 |
| 17 | 2.4 | ○ | ○ | 83 |
| | | COMPARATIVE | | |
| 18 | 2.1 | ○ | ◎ | 84 |
| 19 | 2.2 | ○ | ○ | 76 |
| 20 | 2.2 | X | X | 96 |
| 21 | 2.1 | X | Δ | 0 |
| 22 | 2.3 | X | ○ | 0 |

TABLE 2

(Test Results of Coated Galvannealed Steel Sheets)

| Composition No. | Test 1 Coef. of friction | Test 2 Change of forming load (kgf) | Test 3 Removability with Alkali | Test 4 Anti-block Properties | Test 5 Resistance to wash oil |
|---|---|---|---|---|---|
| | | THIS INVENTION | | | |
| 1 | 0.180 | 146 | ○ | ○ | 80 |
| 2 | 0.172 | 127 | ○ | ◎ | 89 |
| 3 | 0.114 | 56 | ○ | ◎ | 91 |
| 4 | 0.120 | 58 | ○ | ○ | 98 |
| 5 | 0.126 | 69 | ○ | ○ | 92 |
| 6 | 0.121 | 72 | ○ | ○ | 60 |
| 7 | 0.119 | 70 | ○ | ◎ | 87 |
| 8 | 0.174 | 111 | ○ | ◎ | 90 |
| 9 | 0.122 | 68 | ○ | ◎ | 88 |
| 10 | 0.124 | 83 | ○ | ○ | 88 |
| 11 | 0.184 | 164 | Δ | ○ | 62 |
| 12 | 0.114 | 62 | ○ | ○ | 72 |
| 13 | 0.144 | 77 | ○ | ○ | 94 |
| 14 | 0.155 | 105 | ○ | ○ | 81 |
| 15 | 0.118 | 83 | ○ | ◎ | 87 |
| 16 | 0.113 | 79 | ○ | ◎ | 94 |
| 17 | 0.159 | 99 | ○ | ○ | 80 |
| | | COMPARATIVE | | | |
| 18 | 0.363 | 189 | ○ | ◎ | 94 |
| 19 | 0.227 | 165 | ○ | ◎ | 78 |
| 20 | 0.362 | 200 | X | ◎ | 95 |
| 21 | 0.207 | 185 | X | Δ | 0 |
| 22 | 0.215 | 195 | X | ○ | 0 |

What is claimed is:

1. A solid surface organic lubricating coating composition for plastic deformation of a metal sheet comprising a maleic anhydride/styrene copolymer which has been at least partially esterified with one or more organic hydroxy compounds, or a salt of the esterified maleic anhydride/styrene copolymer, wherein the molar ratio of the maleic anhydride component to the styrene component in the copolymer is in the range of from 1:99 to 75:25, and wherein at least 10% by weight of said one or more organic hydroxy compounds is comprised of at least one hydroxy compound having an alkyl or alkenyl group having from 10 to 30 carbon atoms.

2. The coating composition of claim 1 wherein the molar ratio of the maleic anhydride component to the styrene component in the copolymer is in the range of from 10:90 to 50:50.

3. The coating composition of claim 1 wherein the copolymer consist essentially of recurring units derived from maleic anhydride and styrene.

4. The coating composition of claim 1 wherein the copolymer has a number-average molecular weight of from 200 to 100,000.

5. The coating composition of claim 4 wherein the copolymer has a number-average molecular weight of from 500 to 10,000.

6. The coating composition of claim 1 wherein at least 30% by weight of said one or more organic hydroxy compounds is comprised of at least one hydroxy compound having an alkyl or alkenyl group having from 10 to 30 carbon atoms.

7. The coating composition of claim 1 wherein at least 10% by weight of said one or more organic hydroxy compounds is comprised of at least one hydroxy compound having an alkyl or alkenyl group having from 12 to 22 carbon atoms.

8. The coating composition of claim 1 wherein the copolymer has been esterified to a degree of esterification of at least 5%.

9. The coating composition of claim 8 wherein the degree of esterification of the copolymer is in the range of from 10% to 90%.

10. The coating composition of claim 9 wherein the degree of esterification of the copolymer is in the range of from 20% to 70%.

11. The coating composition of claim 1 wherein the esterified copolymer is present in the form of a salt with a basic compound.

12. The coating composition of claim 11 wherein the basic compound is selected from ammonia, amines, and inorganic metal-containing bases.

13. The coating composition of claim 1 wherein the composition is an aqueous composition in which the esterified copolymer or its salt is dissolved, emulsified, or dispersed in water.

14. The coating composition of claim 13 wherein the esterified copolymer or its salt is present in the composition in a concentration of from 1% to 50% by weight.

15. A lubricated metal sheet having a surface lubricating coating formed from the organic lubricating coating composition of claim 1 on at least one surface thereof.

16. The lubricated metal sheet of claim 15 wherein the metal sheet is a steel sheet.

17. The lubricated metal sheet of claim 16 wherein the steel sheet is a plated steel sheet having a zinc or zinc alloy plating layer.

18. The lubricated metal sheet of claim 15 wherein the coating has a weight of from 0.1 to 10 $g/m^2$ on a dry basis.

19. The lubricated metal sheet of claim 18 wherein the coating weight is from 0.2 to 3 $g/m^2$ on a dry basis.

* * * * *